United States Patent [19]

Mensch

[11] Patent Number: 4,819,349

[45] Date of Patent: Apr. 11, 1989

[54] OFFAL SCRAPER

[76] Inventor: Donald Mensch, 2721 Bauer Rd., Jenison, Mich. 49428

[21] Appl. No.: 18,625

[22] Filed: Feb. 25, 1987

[51] Int. Cl.[4] ..... E02F 3/76

[52] U.S. Cl. ..... 37/117.5; 37/233; 172/684.5

[58] Field of Search ..... 37/117.5, 233; 172/519, 172/189, 200, 612, 684.5, 747

[56] References Cited

U.S. PATENT DOCUMENTS

| | | | |
|---|---|---|---|
| 2,986,826 | 6/1961 | Timmons | 37/117.5 |
| 3,469,330 | 9/1969 | Hood et al. | 37/117.5 |
| 3,665,622 | 5/1972 | Lamb | 37/117.5 |
| 3,666,020 | 5/1972 | Hess | 172/612 |
| 4,043,060 | 8/1977 | Stepe | 37/117.5 X |
| 4,189,854 | 2/1980 | Haynes | 37/117.5 |
| 4,200,423 | 4/1980 | Sornsih | 37/117.5 X |
| 4,255,884 | 3/1981 | Williams | 37/117.5 |
| 4,417,628 | 11/1983 | Gessner | 37/117.5 X |
| 4,420,189 | 12/1983 | von Ruden | 37/117.5 X |
| 4,583,307 | 4/1986 | Lenert | 37/233 |
| 4,597,205 | 7/1986 | Guest | 37/117.5 X |

FOREIGN PATENT DOCUMENTS

| | | | |
|---|---|---|---|
| 2451425 | 11/1980 | France | 37/117.5 |

*Primary Examiner*—Edgar S. Burr
*Assistant Examiner*—Moshe L. Cohen
*Attorney, Agent, or Firm*—Price, Heneveld, Cooper, DeWitt & Litton

[57] ABSTRACT

An attachment scraper assembly for clearing offal and the like from barns. A bracket assembly is connected to a scraper element that is formed from a vehicle tire. To affix the scraper assembly to the bucket of a front end loader, the operator inserts the lower wall of the bucket under an elevated, downwardly facing and rearwardly, downwardly sloping support surface of the bracket assembly. The scraper assembly will be firmly suspended between the support surface and a rear edge of the scraper element when the bucket is raised. The scraper assembly may thus be attached to, and detached from, a bucket without requiring the operator to dismount the front end loader.

14 Claims, 3 Drawing Sheets

FIG. 1
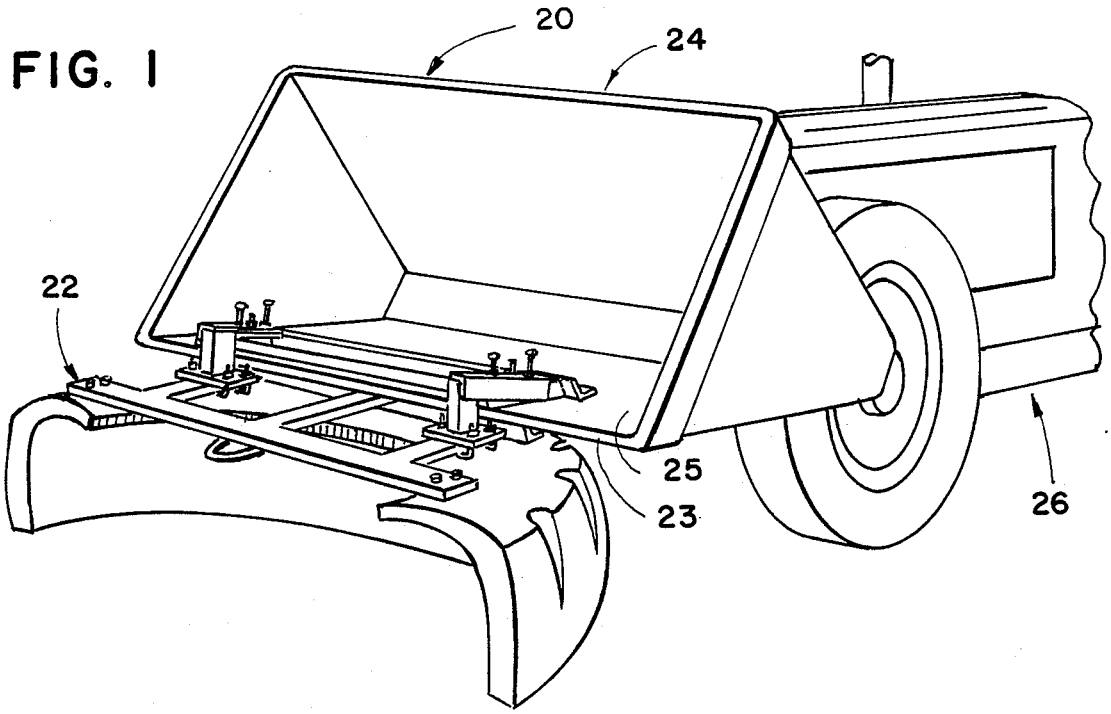
FIG. 7
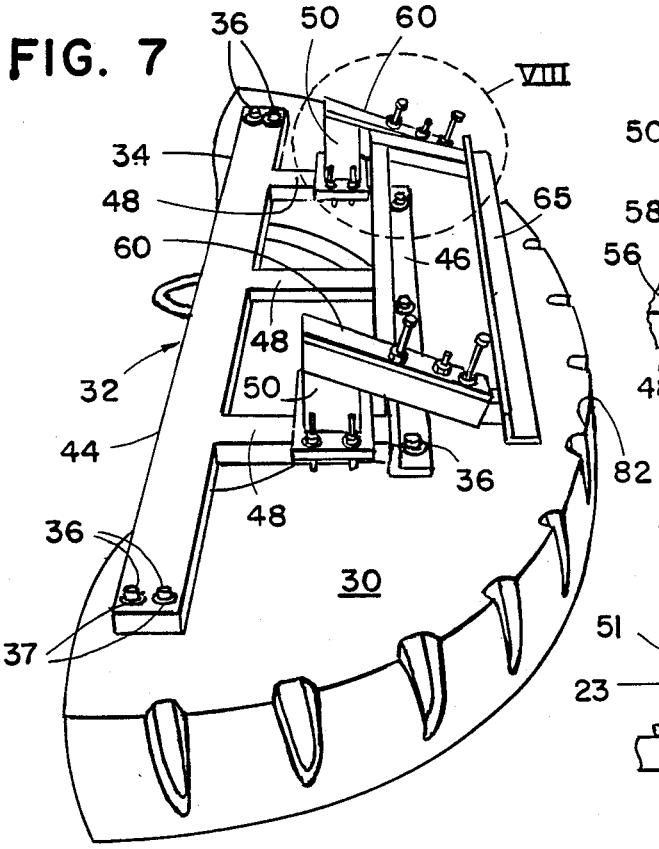
FIG. 8
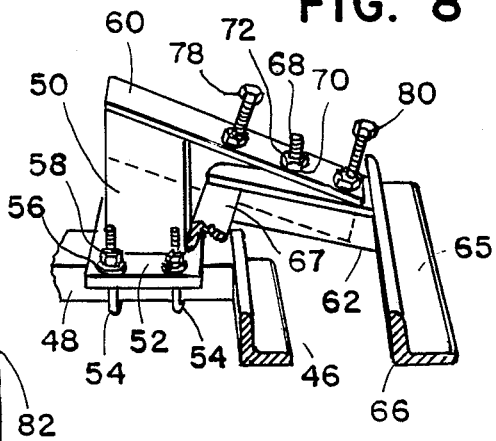
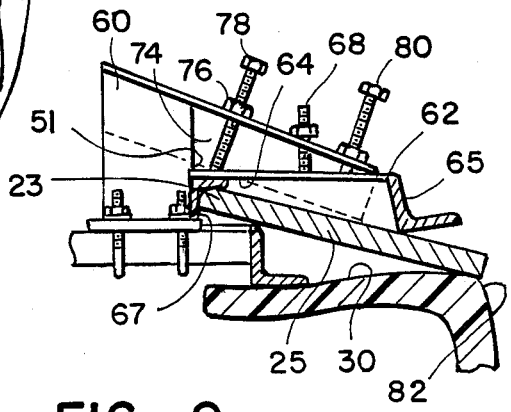
FIG. 9

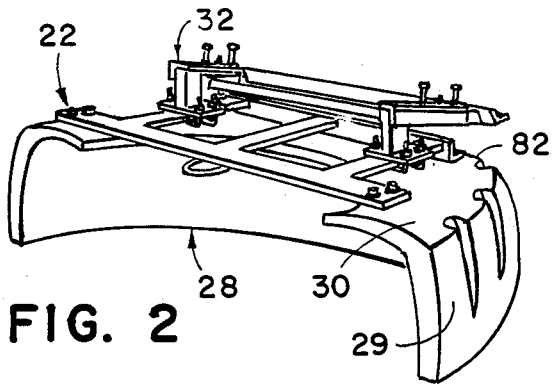
FIG. 2
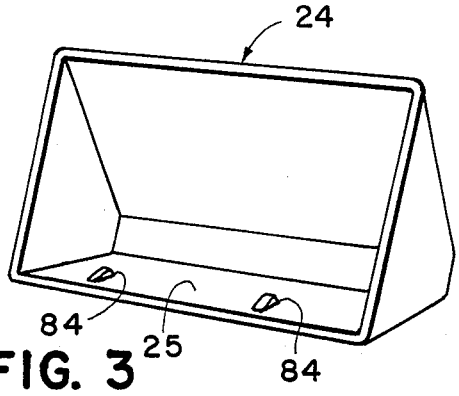
FIG. 3
FIG. 4
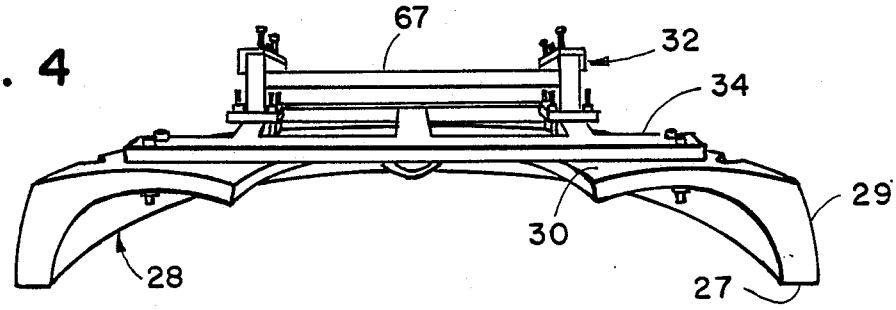
FIG. 5
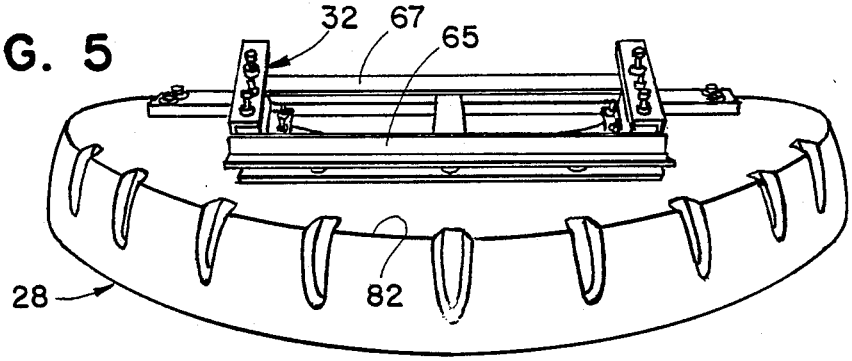
FIG. 6
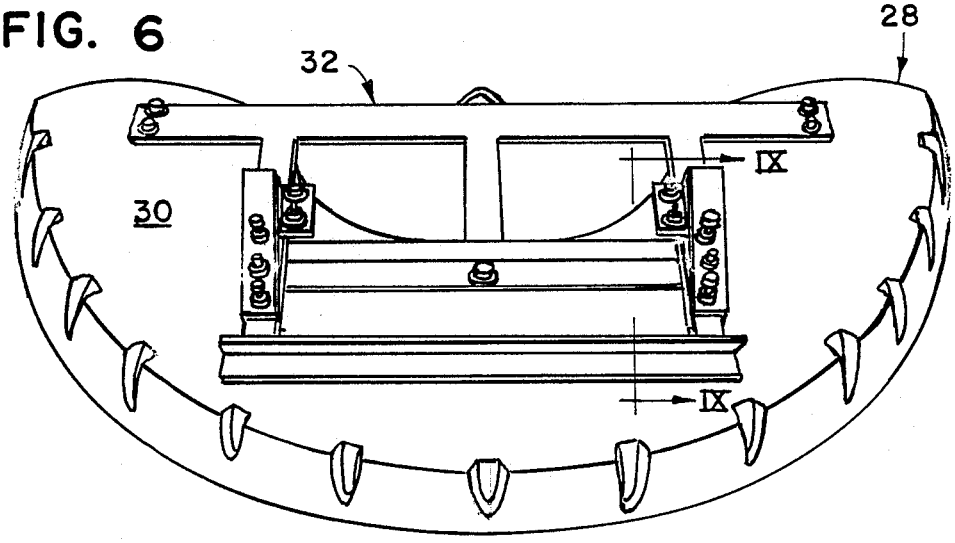

FIG. 10
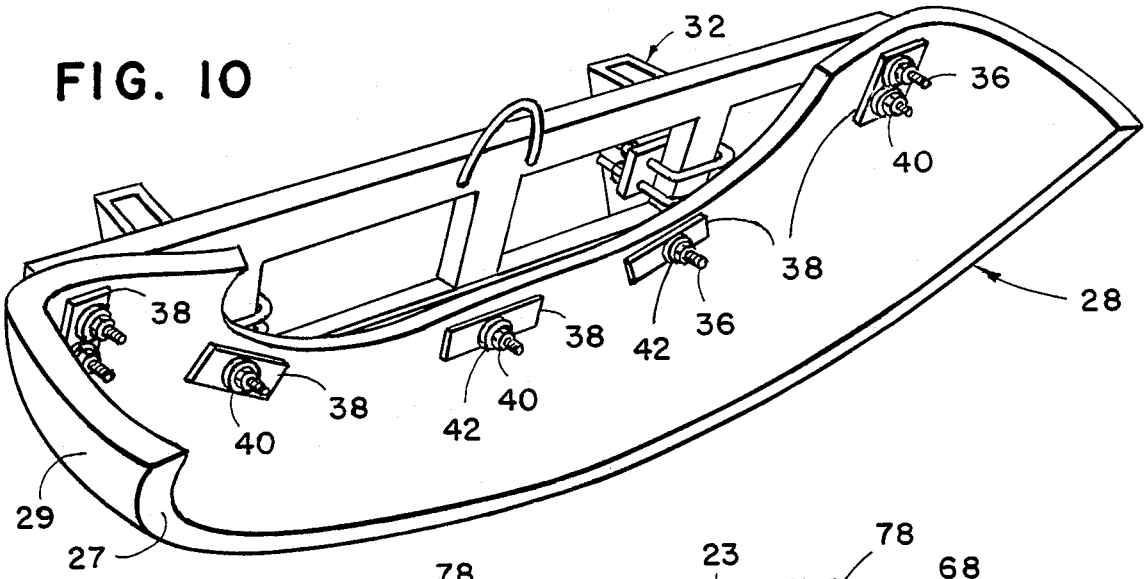
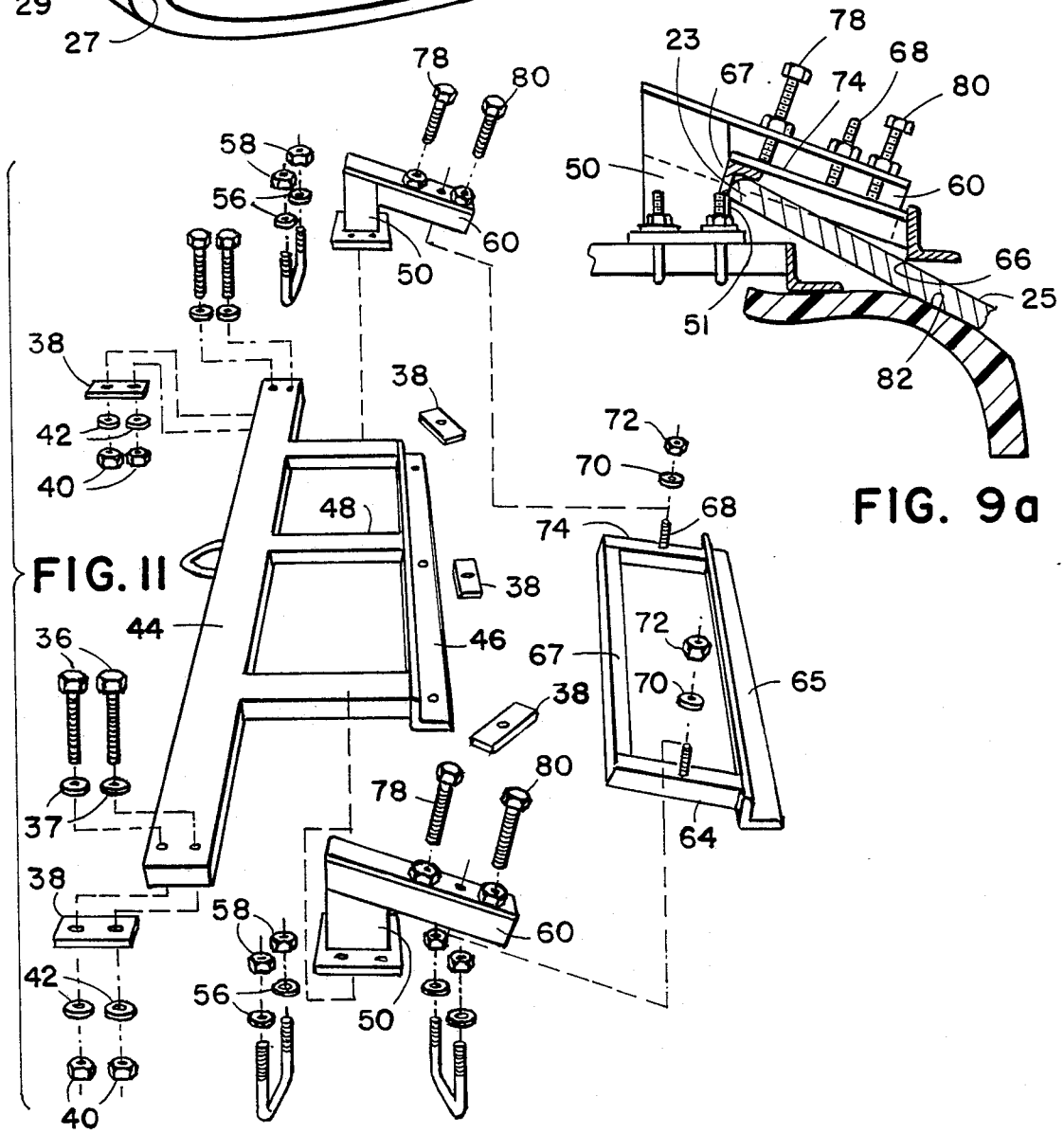
FIG. 11
FIG. 9a

OFFAL SCRAPER

BACKGROUND OF THE INVENTION

This invention relates to scrapers and in particular to scraper assemblies of the type that are readily attachable to the bucket of a front end loader for moving offal and the like. Offal, which is animal waste and other debris, accumulates in barns and must be periodically removed. Various removal systems have been installed in barns but their high capital cost and lack of versatility are a disadvantage.

Accordingly, it is an object of the invention to provide an offal scraper that is portable, inexpensive and is manipulated as an attachment to the bucket of a front end loader or similar equipment. It is a further object to provide an offal scraper assembly that can be attached to, and detached from, a front end loader bucket without requiring the operator to dismount the vehicle.

SUMMARY OF THE INVENTION

An attachment scraper assembly according to the present invention has a scraper element and a mounting bracket assembly attached to an upwardly facing mounting surface of the scraper element. The bracket assembly has an elevated, downwardly facing and rearwardly, downwardly sloping support surface. To affix the scraper assembly to a bucket, the operator need only insert the lower wall of the bucket under the support surface of the scraper assembly and rotate the bucket front upwardly. The scraper will be firmly suspended between the support surface and a rear edge of the scraper mounting surface. Forward motion of the bucket will be transferred to the scraper element through a rear face of vertical members forward the support surface.

In one embodiment, the scraper element is a removed portion of a tire and the tire rubber tread forms the rear edge of the scraper mounting surface to increase frictional engagement between the scraper assembly and the bucket. In another embodiment, the supporting surface is adjustable pivotally mounted to provide a more permanent attachment to a bucket, requiring a minimum of tools and no separate fastening elements. In yet another embodiment, a minor modification made to a bucket provides an even stronger attachment of the scraper assembly to the bucket.

One aspect of the invention, therefore, is an offal scraper that can be mounted to the bucket of a front end loader without requiring the operator to dismount the front end loader. Another aspect is a scraper attachment device that can be mounted to the bucket of a front end loader without requiring modification of the bucket and without requiring separate fastener elements that can become misplaced. Another aspect is a scraper attachment device that, while capable of being mounted to the bucket of a front end loader without requiring the operator to dismount and without modification to the bucket, can be very rigidly attached to a bucket in a semi-permanent fashion with only slight modification to the bucket, without special tools and without separate fastening elements.

These and other related objects, advantages and features of this invention will become apparent upon review of the following specification in conjunction with the drawings.

BRIEF DESCRIPTION OF THE DRAWINGS

FIG. 1 is a front perspective view showing a scraper assembly affixed to the bucket of a front end loader;

FIG. 2 is a front perspective view of a scraper assembly according to the invention;

FIG. 3 is an isolated perspective view of the bucket of a front end loader that has been modified according to an embodiment of the invention;

FIG. 4 is an elevated front view of the scraper assembly in FIG. 2;

FIG. 5 is an elevated rear view of the scraper assembly in FIG. 2;

FIG. 6 is a top plan view of the scraper assembly in FIG. 2;

FIG. 7 is a side perspective view of the scraper assembly in FIG. 2;

FIG. 8 is an enhanced side perspective view of a portion of the scraper assembly in FIG. 7;

FIG. 9 is a partial sectional elevated side view along the lines IX—IX in FIG. 6;

FIG. 9*a* is the same as FIG. 9 except that the adjustment screws have been rotated to pivot the supporting surface of the mounting bracket assembly;

FIG. 10 is a bottom front perspective view of the scraper assembly of FIG. 2; and FIG. 11 is an exploded view of the scraper assembly in FIG. 2 showing the various components disassembled.

DESCRIPTION OF THE PREFERRED EMBODIMENT

Referring now specifically to the drawings, and the illustrative embodiments depicted therein, FIG. 1 shows an offal scraper-prime mover combination generally at 20. Combination 20 comprises a front end loader 26, or other prime mover, having a bucket 24 connected to prime mover 26 by control members (not shown) that are capable of raising, lowering and rotating the bucket in response to commands from an operator stationed in a cab (not shown). Bucket 24 is an open-ended receptacle facing generally forward and having a bottom wall 25 which defines a front edge 23. The offal scraper assembly 22 is shown suspended from bottom wall 25 in a cantilever fashion.

Referring to FIGS. 2–6, scraper assembly 22 comprises a scraper element 28 having an upward facing horizontal mounting surface 30 that is affixed to a mounting bracket assembly 32 in a manner that will be described in detail below. Scraper element 28 has a downward extending wall 29 connected to a perimeter edge 82 of the mounting surface 30. Wall 29 terminates in a downwardly facing generally flat surface 27. A close inspection reveals that scraper element 28 is constructed from a portion of a vehicle tire of the type used on heavy construction equipment. Scraper element 28 comprises a portion of a vehicle tire, with the mounting surface 30 the tire sidewall, scraper wall 29 the tire tread and bottom edge 27 formed as by cutting through the tread section perpendicular to the axis of rotation of the tire. A tire section is desirable for use as an offal scraper because the reinforced rubber composite construction of the tire provides a squeegee action as it is moved forwardly along a floor surface and the general curvilinear profile of the tire provides a scoop design that allows a large amount of offal to be accumulated within the confines of the scraper element.

Mounting bracket assembly 32 will now be described in more detail. Referring to FIG. 7, bracket assembly 32 has a base portion 34 that is attached to mounting surface 30 of scraper element 28 by a plurality of screw fasteners 36 extending through aligned openings in the base portion 34 and in scraper element 28. A backing plate 38 (FIG. 10) is installed over one or more fasteners 36 before a nut 40 is installed and tightened on each fastener. An optional flat washer 37 may be installed between a fastener 36 and base portion 34. Base portion 34 is generally planar and has a forward cross brace 44 and a rear cross brace 46 interconnected by a plurality of spaced longitudinal braces 48 to form a rigid plate-like member.

A pair of connecting members 50 extend vertically upward from base portion 34. Each connecting member 50 has a horizontal mounting flange 52 at its base portion that is connected to a longitudinal brace 48 by a pair of U-bolts 54 around the brace and extending through apertures in flange 52. A nut 58 and lock washer 56 are assembled on each threaded portion of the U-bolt.

A generally horizontal, downwardly opening angle shaped support bracket 60 extends rearwardly from each connecting member 50. A support member 62 is connected within the channel of each support bracket 60. Screw means are provided for adjustably attaching support member 62 to support bracket 60 as will now be explained.

Reference is made to FIG. 9 wherein a stud 68 is rigidly attached to member 62 and extending upwardly through an opening in bracket 60. A nut 72 is threaded over the stud 68. With this arrangement, member 62 is free to pivot about stud 68 within the channel portion of bracket 60. A pair of adjustment screws 78, 80 are threadably retained within inserts 76, on different sides of stud 68, on bracket 60. Screws 78, 80 extend downwardly into contact with an upwardly facing adjustment surface 74 of support member 62. It can be seen that in general, extension of forward adjustment screw 78 and retraction of rear adjustment screw 80 will rotate support member 62 in a counterclockwise manner around stud 68. Similarly, extension of rear adjustment screw 80 and retraction of forward adjustment screw 78 will rotate member 62 clockwise around stud 68. Each support member 62 has a downwardly facing support surface 64, whose function will be described in more detail below. A rear portion of the support members 62 are rigidly interconnected by a rear support tie channel 65 and a front portion of members 62 are rigidly interconnected by a front support channel 67.

It is contemplated that the offal scraper will be stored in a horizontal position such as shown in FIG. 7. To attach the scraper assembly 22 to a front end loader bucket 24 it is only necessary to insert the bucket bottom wall 25, from the rear, under support surface 64 and to elevate the bucket front edge by rotating the bucket upwardly. As seen in FIG. 9, the scraper assembly will be supported on bottom wall 25 at least at two points, on downwardly facing support surface 64 and upwardly facing rear edge portion of perimeter edge 82. The rigid support surface of the mounting assembly 32 will support the entire scraper assembly and the engagement with rubber rear edge 82 will provide sufficient gripping force to prevent accidental lateral movement of the scraper assembly off the bucket bottom wall.

A rearwardly extending surface 51 of connecting members 50 is abutted by the front edge 23 of a bucket bottom wall to translate forward motion of the bucket to the scraper assembly 22.

The use of the present invention to scrape offal will now be described. With the scraper assembly 22 in its horizontal storage position, the bucket 24 is inserted between support surface 64 and mounting surface 30. The bucket is rotated upwardly, attaching the scraper assembly to the bottom wall of the bucket. The scraper assembly 22 can now be transported to the site where it will be used. In order to move offal, the assembly 22 is again lowered to the floor. The forward movement of the bucket moves the assembly 22 forwardly where the offal is collected in a squeegee fashion within the confines of scraper wall 29. At the end of a forward offal-moving stroke, the bucket may be elevated, lifting the scraper assembly 22 off the ground, and the front end loader is then moved to the next position where scraping is to occur. This process may be repeated until the clean-up job is complete. At the end of the clean-up job, the scraper assembly 22 is moved to its storage site and the bucket is rotated to a horizontal orientation. The front end loader is backed away leaving the scraper assembly in its storage position. The entire operation just described can be carried out without the need for the operator of the front end loader to dismount from the cab to perform any manual assembly or disassembly tasks.

If it is desired to provide a more rigid attachment of the offal scraper to the bucket bottom wall, it is only necessary to extend rear adjustment screw 80 until the bottom wall 25 of the bucket compresses and deforms rear edge 82 of the mounting wall 30, as is shown in FIG. 9*a*. When such a rigid attachment is no longer desired, rear adjustment screw 80 is retracted and forward adjustment screw 78 extended, as shown in FIG. 9, to open the throat formed between support surface 64 and mounting surface 3 in order to allow plenty of room to subsequently insert the bucket bottom wall in the fashion previously described.

The previously described mounting of the scraper assembly 22 to bucket 24 required no modification to the bucket. By the slight addition of a pair of keepers 84 to the bottom wall 25 as by welding, additional lateral engagement may be obtained between the bucket and the scraper assembly without interfering with the normal operation of the bucket 24.

Changes and modifications in the specifically described embodiments can be carried out without departing from the scope of the invention which is intended to be limited only by the scope of the appended claims.

The embodiments of the invention in which an exclusive property or privilege is claimed are defined as follows:

1. An attachment scraper assembly for removable retention on the bottom wall of a front end loader bucket comprising:

a scraper element having an upwardly facing mounting surface defining a rear edge;

a mounting bracket assembly attached to said mounting surface;

said mounting bracket assembly defining a downwardly facing support surface spaced above said mounting surface a distance that is sufficiently great to define a laterally oriented, rearwardly facing throat therewith that is capable of receiving a bucket bottom wall moved toward said throat by operating a front end loader having such a bucket; and said support surface being rearwardly downwardly sloping such that said support surface and said rear edge define substantially the sole vertical support for said scraper assembly and said scraper assembly is capable of being supported in cantilever fashion by a bucket bottom wall that is inserted in the throat without requiring the use of fasteners.

2. The scraper assembly in claim 1 wherein said scraper element is a reinforced rubber composite.

3. The scraper assembly in claim 2 wherein said scraper element is additionally a removed portion of a vehicle tire, and said mounting surface is a sidewall of said tire.

4. The scraper assembly in claim 1 further having adjustment means for rotatably adjsutably positioning said support surface on said bracket assembly, whereby said support surface is capable of being positioned to rigidly secure the bucket bottom wall between said support surface and said scraper element rear edge.

5. An attachment scraper assembly for removable retention on the bottom wall of a front end loader bucket comprising:

a scraper element having a generally planar, upward facing mounting surface defining a perimeter edge and a scraper wall extended downwardly from said perimeter edge and terminating in a generally flat bottom edge;

a mounting bracket assembly above said scraper element, said bracket assembly comprising a base portion abutting said mounting surface, a first connecting member extending upwardly from said base portion a first support bracket extending rearwardly form an upper portion of said connecting member, a first support member attached to said support bracket and defining a downwardly facing support surface, said support surface rearwardly downwardly sloping, and screw means for attaching said support member to said support bracket spaced above said mounting surface a distance that is sufficiently great to receive a bucket bottom wall between said support surface and said mounting surface that is positioned by an operator operating a front and loader having such a bucket; and fastening means for attaching said mounting bracket assembly to said scraper element;

said support member and said mounting surface defining means for supporting said scraper assembly in a cantilever fashion by a bucket bottom wall without requiring the user of fasteners.

6. The scraper assembly in claim 5 wherein said screw means comprises a pair of longitudinally spaced threaded apertures in said support bracket, a pair of screws, one said screw adjustably extending downwardly from each said aperture toward said support member, a stud extending upwardly from said support member and pivot means for pivotally mounting said stud to said support bracket between said screws.

7. The scraper assembly in claim 5 wherein said fastening means comprises a plurality of fasteners extending through aligned openings in said base portion and said scraper element and a backing plate between each said fastener and the scraper element.

8. The scraper assembly in claim 5 wherein said scraper element is a removed portion of a vehicle tire and said mounting surface is a sidewall of said tire.

9. The scraper assembly in claim 5 having a second connecting member extending upwardly form said base portion spaced from said first connecting member, a second support bracket extending rearwardly from an upper portion of said second connecting member, a second support member attached to said second support bracket and defining a second downwardly facing support surface, said second support surface downwardly rearwardly sloping, screw means for attaching said second support member to said second support bracket spaced above said mounting surface substantially the same distance as said first support member and support tie connecting rear portion of said first and second support members.

10. The scraper assembly in claim 9 wherein said first connecting member defines a first rear surface and said second connecting member defines a second rear surface, said rear surfaces contacted by a front edge of a bucket bottom wall subjacent said support surface to transmit forward horizontal motion from said bucket to said scraper assembly.

11. The scraper assembly in claim 8 wherein said base portion comprises a forward lateral cross brace, a rear lateral cross brace, and a plurality of spaced longitudinal braces between said forward and rear braces.

12. A scraper assembly comprising:

a generally horizontally opening bucket defining a bottom wall and a front edge;

prime mover means for rotating and horizontally moving said bucket;

a scraper element comprising substantially a quarter portion of a vehicle tire, said scraper element having a top mounting surface comprising a portion of a sidewall of said tire, an outwardly forwardly curved scraping wall perpendicular to said mounting surfaces defined by a portion of a tread section of said tire and means defining a bottom edge of said scraping wall extending in a plane that is generally parallel said mounting surface; and mounting means for mounting said scraper element to said bucket including means for transmitting downward forces from said bucket to said scraper element to selectively engage a horizontal surface with said bottom edge and to slide said bottom edge over the horizontal surface in a squeegee fashion, said mounting means including a mounting bracket assembly having a base portion rigidly attached to said mounting surface and support means rigidly attached to said base portion, said support means having surface means for defining a rearwardly opening throat configured to receive a forward portion of said bucket bottom wall in order to selectively raise, lower and forwardly propel said scraper element.

13. The scraper assembly in claim 12 further having a pair of keeper means on said bucket bottom wall for laterally restraining said bracket assembly.

14. The scraper assembly in claim 12 wherein said throat defines a downwardly facing support surface spaced above said mounting surface and rearwardly downwardly sloping.

* * * * *

UNITED STATES PATENT AND TRADEMARK OFFICE

CERTIFICATE OF CORRECTION

PATENT NO. : 4,819,349

DATED : April 11, 1989

INVENTOR(S) : Donald Mensch

It is certified that error appears in the above-identified patent and that said Letters Patent is hereby corrected as shown below:

Column 4, line 37:
"surface 3" should be --surface 30--.

Column 5, Claim 4, line 16:
"adjsutably" should be --adjustably--.

Column 5, Claim 5, line 35:
"form" should be --from--.

Column 5, Claim 5, line 51:
"user" should be --use--.

Column 6, Claim 9, line 5:
"form" should be --from--.

Column 6, Claim 9, line 15:
After "and" insert --a--.

Column 6, Claim 9, line 16:
"portion" should be --portions--.

UNITED STATES PATENT AND TRADEMARK OFFICE

CERTIFICATE OF CORRECTION

PATENT NO. : 4,819,349

DATED : April 11, 1989

INVENTOR(S) : Donald Mensch

It is certified that error appears in the above-identified patent and that said Letters Patent is hereby corrected as shown below:

Column 6, Claim 11, line 25:

"claim 8" should be --claim 9--.

Column 6, Claim 12, line 39:

"surfaces" should be --surface--.

Signed and Sealed this

Seventeenth Day of April, 1990

*Attest:*

HARRY F. MANBECK, JR.

*Attesting Officer*

*Commissioner of Patents and Trademarks*